US005318631A

United States Patent [19]

Tsukamoto

[11] Patent Number: 5,318,631

[45] Date of Patent: Jun. 7, 1994

[54] PRESSURE CONTROL DEVICE FOR A PRESSURE ROLLER

[75] Inventor: Kimihide Tsukamoto, Yamatokoriyama, Japan

[73] Assignee: Sharp Kabushiki Kaisha, Osaka, Japan

[21] Appl. No.: 809,979

[22] Filed: Dec. 18, 1991

[30] Foreign Application Priority Data

Dec. 18, 1990 [JP] Japan ..... 2-403373

[51] Int. Cl.[5] ..... G03G 15/12; B05C 13/02; B05C 1/02

[52] U.S. Cl. ..... 118/704; 118/651; 118/231; 118/247; 355/277

[58] Field of Search ..... 118/46, 704, 651, 122, 118/121, 231, 241, 247, 245; 101/171; 355/277, 295, 271, 273

[56] References Cited

U.S. PATENT DOCUMENTS

| | | | |
|---|---|---|---|
| 3,754,819 | 8/1973 | Braun | 355/295 |
| 3,866,572 | 2/1975 | Gundlach | 118/661 |
| 3,867,026 | 2/1975 | Ogawa | 355/235 |
| 3,901,186 | 8/1975 | Hoffman et al. | 118/638 |
| 4,392,739 | 4/1983 | Brown et al. | 355/295 |

FOREIGN PATENT DOCUMENTS

| | | | |
|---|---|---|---|
| 123107 | 10/1984 | European Pat. Off. | 355/295 |
| 6363077 | 3/1981 | Japan | 355/295 |
| 56-81878 | 7/1981 | Japan | 355/295 |
| 60-86575 | 5/1985 | Japan | 355/295 |
| 1-248168 | 10/1989 | Japan | 355/277 |
| 2-281253 | 11/1990 | Japan | 355/277 |
| 1116412 | 9/1984 | U.S.S.R. | 355/295 |

*Primary Examiner*—W. Gary Jones
*Assistant Examiner*—Todd J. Burns
*Attorney, Agent, or Firm*—David G. Conlin; Henry D. Pahl, Jr.

[57] ABSTRACT

A pressure control device for controlling the application of pressure provided by a pressure roller to a pressing object, which includes a support member for pivotally supporting the pressure roller, a locking member coupled with the support member, an eccentric cam switchable between a locked state and an unlocked state by the locking member, a clutch for rotating the eccentric cam by a driving means connected thereto, and a solenoid for pushing or pulling the joint portion of the support member and the locking member so as to allow both members to move pivotally. When the solenoid is turned on and the locking of the eccentric cam is released from the locking member, the clutch rotates the eccentric cam thereby moving the solenoid. The pulling force of the solenoid pivotally move the support member strongly enough to allow the pressure roller to press the pressing object. When the solenoid is turned off at this state, the pressure roller is moved downward away from the pressing object by weight.

7 Claims, 5 Drawing Sheets

PRESSURE CONTROL DEVICE FOR A PRESSURE ROLLER

BACKGROUND OF THE INVENTION

1. Field of the Invention

The present invention relates to a pressure control device for a pressure roller, and more particularly to a pressure control device for controlling the application of pressure provided by a pressure roller such as a transfer roller and a pressing roller for a fixing device to a pressing object in an image forming apparatus including the same.

2. Description of the Prior Art

An image forming apparatus such as a printer and a copying machine is provided with a pressure roller for applying a pressure to a pressing object such as a photosensitive drum. Such a pressure is conventionally controlled by the methods as described below.

FIG. 10 shows one of the conventional pressure control devices for a pressure roller. The device comprises a lever 50 which pivotally moves around a horizontal support 51 and supports a transfer roller 5 at one end thereof. The transfer roller 5 is disposed below a photosensitive drum 1. The transfer roller 5 normally presses the photosensitive drum 1, and the pressure is released by manually pushing the opposite end of the lever 50 to the transfer roller 5, against the urging force of a spring 52. This operation is required, for example, when jamming occurs between the photosensitive drum 1 and the transfer roller 5.

Since the above conventional device is manually operated, good operability is not possible, and a longer time is required to release the jamming. Further, the transfer roller 5 normally presses the photosensitive drum 1 with the urging force of the spring 52, which over time may cause deformation of both the photosensitive drums 1 and the transfer roller 5.

FIG. 11 shows a second type of the conventional pressure control device a pressure roller, in which a solenoid 6 is added to the above device together with a plunger 60 for coupling the solenoid 6 to the lever 50. When jamming occurs, the solenoid 6 is turned on so as to allow the plunger 60 to withdraw. This is followed by the pivotal movement of the lever 50 in such a direction that the transfer roller 5 supported thereto moves away from the photosensitive drum 1 and the pressure therebetween is thereby released.

In the above conventional device, the lever 50 is directly moved by the solenoid 6. This structure is disadvantageous in that it requires a large solenoid and, as a result, the image forming apparatus becomes complicate and large, requiring further costs.

FIG. 12 shows a third type of the conventional pressure control device, in which the lever 50 is pivotally moved by the combination of the solenoid 6 and a spring clutch 7 so as to release the pressure of the transfer roller 5 from the photosensitive drum 1. Normally, the solenoid 6 is not energized, and a sleeve 70 of the spring clutch 7 is engaged with a ratch 61 coupled to the plunger 60 of the solenoid 6, so as to lock a cam 71 of the spring clutch 7 in order to prevent it from rotating. When jamming occurs and the solenoid 6 is turned on, the cam 71 is unlocked and starts to rotate, allowing the lever 50 to pivotally move in such a direction that the transfer roller 5 supported thereto moves away from the photosensitive drum 1 and the pressure therebetween is released.

The above conventional device still has a disadvantage. When the main electric source of the image forming apparatus is turned off, the main motor which drives various drive systems thereof stops. In this respect, when the main electric source is turned off with the transfer roller 5 pressing the photosensitive drum 1, the pressure application is maintained. Thus, if the image forming apparatus is kept unused for a long period of time, both the photosensitive drum 1 and the transfer roller 5 may be deformed due to the pressure against each other.

The image forming apparatus employing the above conventional pressure control devices is normally provided with a timing roller which transports a sheet so that it passes between the photosensitive drum 1 and the transfer roller 5. The timing roller is conventionally provided with a solenoid other than the above solenoid 6 so as to control the rotation of the timing roller. As a result, the structure of the apparatus becomes large and complicated with the increased number of components, and this also makes it difficult to realize cost reduction.

An objective of the present invention is to solve the above-described prior art deficiencies by providing a pressure control device for a pressure roller which ensures the prompt release of jamming and which prevents both a pressing object and a pressure roller from being deformed when the image forming apparatus is left unused for a long period of time.

Another objective of the present invention is to simplify the structure of the image forming apparatus and to achieve cost reductions thereof.

SUMMARY OF THE INVENTION

The pressure control device for a pressure roller of this invention, which overcomes the above-discussed and numerous other disadvantages and deficiencies of the prior art, controls the application of pressure provided by the pressure roller to a pressing object, and comprises a support member for pivotally supporting the pressure roller, a locking member coupled with the support member, an eccentric cam switchable between a locked state and an unlocked state by the locking member, a clutch for rotating the eccentric cam by a driving means connected thereto, a solenoid for pushing or pulling the joint portion of the support member and the locking member so as to allow both members to move pivotally; and wherein, upon energization of the solenoid, the eccentric cam is unlocked from the locking member and rotated, thereby moving the solenoid.

In a preferred embodiment, the solenoid is held by a holder, and the holder is pushed by the eccentric cam to move together with the solenoid.

In a preferred embodiment, the clutch is a spring clutch.

In a preferred embodiment, the locking member includes a ratch engageable with a claw formed on a sleeve of the spring clutch.

In a preferred embodiment, the pressure control device for a pressure roller further comprises a rotary locking mechanism having a second locking member and a second spring clutch coupled to the opposite end of the support member to the locking member, the rotary locking mechanism operating to either lock or unlock the rotation of a timing roller which timely transports a sheet between the pressure roller and the pressing object.

In a preferred embodiment, the support member is pivotably coupled with a sheet stopper member so as to replace the rotary locking mechanism and the timing roller, thereby controlling the transportation of the sheet.

In a preferred embodiment, the pressure roller is a transfer roller used in an image forming apparatus.

Accordingly, in the pressure control device for a pressure roller of the present invention, the solenoid itself is moved by the rotation of the cam, and the movement of the solenoid is followed by the pivotal movement of the support member supporting the pressure roller, thereby controlling the application of pressure by the pressure roller to a pressing object. According to this structure, the prompt release of jamming is ensured. Further, the pulling force of the solenoid can be maximized, enabling the use of a smaller solenoid so as to realize a compact structure and a cost reduction of the image forming apparatus.

Furthermore, according to the structure of the present invention, when the main electric source is turned off with the pressure roller pressing a pressing object, the pressure of the pressure roller is automatically released, thus preventing the pressure roller and the pressing object from deforming even when the image forming apparatus is left unused for a long period of time.

In one embodiment of this invention, one solenoid can be used both for controlling the pressure application of the pressure roller to a pressing object and for controlling the transportation of a sheet which is transported between the pressure roller and the pressing object. This reduces the number of the components and simplifies the structure of the image forming apparatus so as to realize a further compact structure and cost reductions thereof.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENT

Example 1

Figure 1:
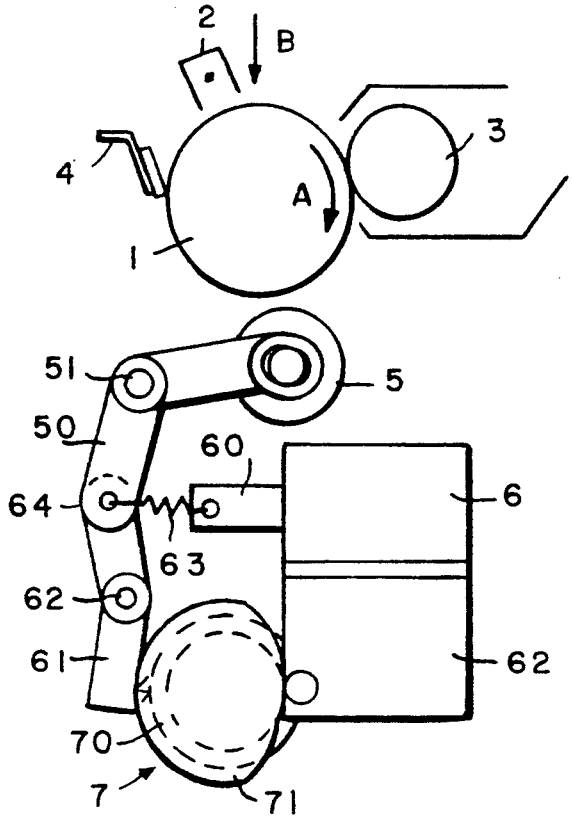
FIG. 1 is a diagrammatic view of a pressure control device of the present invention, showing the state thereof when the pressure of the transfer roller is released from the photosensitive drum.

FIG. 1 shows an example of a pressure control device for a pressure roller of the present invention which is applied to a transfer roller 5 for an image forming apparatus.

Figure 2:
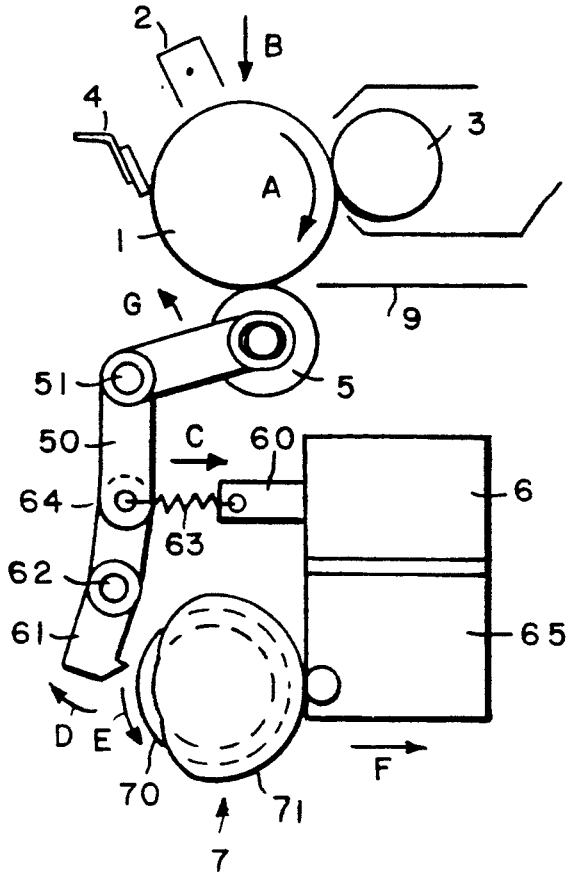
FIG. 2 is a diagrammatic view of the pressure control device of FIG. 1, showing the state thereof when the pressure of the transfer roller is applied to the photosensitive drum.

A photosensitive drum 1 of the image forming apparatus is surrounded by a charger 2, a developing device 3, the transfer roller 5, and a cleaning blade 4 along the direction of rotation of the photosensitive drum 1. The charger 2 uniformly charges the circumferential surface of the photosensitive drum 1 with electricity. The charged surface of the photosensitive drum 1 is then irradiated with light emitted from a light source at the position B, so that an electrostatic latent image is formed on the irradiated portion. Then, the developing device 3 feeds toner onto the portion where the electrostatic latent image has been formed, so as to form a toner image thereon. With the further rotation of the photosensitive drum 1, the toner image comes to the position of the transfer roller 5 which, at this time, presses the photosensitive drum 1 as shown in FIG. 2. Then, the toner image is transferred to a sheet 9 which has just been transported to the position between the photosensitive drum 1 and the transfer roller 5.

The sheet 9 with the toner image transferred thereon is then transported to a fixing device (not shown) located downstream of the transfer roller 5 in the direction of transportation of the sheet 9, so as to fix the toner image on the sheet. After the fixing process the sheet 9 is ejected from the image forming apparatus. The cleaning blade 4 scrapes off residual toner powder left after the transfer process from the circumferential surface of the photosensitive drum 1, so as to be ready for the next cycle of the image forming process.

The transfer roller 5 moves between the position where pressure is applied to the photosensitive drum 1 and the position where the pressure is released therefrom, by means of the pressure control device of this invention comprising a solenoid 6 and a spring clutch 7. The transfer roller 5 is supported on one end of a lever 50 having a horizontal support 51. The other end of the lever 50 is coupled with a pin at a joint portion 64 to one end of a ratch 61 having a horizontal support 62. A spring 63 is connected to the joint portion 64 at one end and to the end of a plunger 60 at the other.

When the solenoid 6 is not energized, as shown in FIG. 1, the ratch 61 coupled to the plunger 60 of the solenoid 6 through the spring 63 locks a sleeve 70 of the spring clutch 7, thereby preventing a cam 71 of the spring clutch 7 from rotating. Thus, the transfer roller 5 is kept away from the photosensitive drum 1.

When the sheet 9 is transported to the position of the transfer roller 5, the solenoid 6 is turned on and, as shown in FIG. 2, the plunger 60 of the solenoid 6 withdraws pulling the joint portion 64 in the direction of arrow C. As a result, the ratch 61 pivotally moves around the horizontal support 62 in the direction of arrow D (clockwise), releasing the locked sleeve 70. Then, the cam 71 connected to a main motor M (see FIG. 3) starts to rotate in the direction of arrow E (counterclockwise), allowing a solenoid holder 65 to move in the direction of arrow F corresponding to the eccentricity of cam 71 produced by the contour thereof. Accompanying this movement, the plunger 60 of the solenoid 6 pulls the joint portion 64 through the spring 63 in the direction of arrow C strong enough to allow the lever 50 to pivotally move in the direction of arrow G (counterclockwise). Thus, the transfer roller 5 comes in contact with the circumferential surface of the photosensitive drum 1 with a desired pressure determined depending on the tensile force of the spring 63.

When the cam 71 completes one rotation, the solenoid 6 together with the solenoid holder 65 returns the original place shown in FIG. 1, and the pressure applied by the transfer roller 5 is released. In this respect, the rotation speed of the cam 71 is appropriately set so that the sheet 9 can pass through between the photosensitive drum 1 and the transfer roller 5 during one rotation of the cam 71. In this way, the transfer process to the sheet 9 is completed before the pressure of the transfer roller 5 to the photosensitive drum 1 is released.

Figure 3:
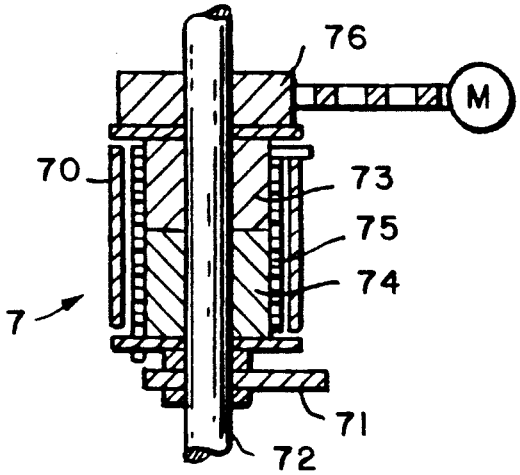
FIG. 3 is a longitudinal sectional view of a spring clutch of the pressure control device of FIG. 1.

FIG. 3 shows the detail of the spring clutch 7 which comprises a boss of a two-part structure composed of first and second bosses 73 and 74 rotatably disposed around a support 72. A gear 76 which transmits a driving force from the main motor M to the first boss 73 is disposed on an end face of the first boss 73. The cam 71 is disposed on the end face of the second boss 74. The sleeve 70 is placed so as to face the circumferential surfaces of the first and second bosses 73 and 74, and a spring 75 is wound between the bosses 73 and 74 and the sleeve 70. One end of the spring 75 is connected to one end portion of the sleeve 70 and the other end thereof is connected to one end portion of the second boss 74. The spring 75 is wound in such a direction that the spring 75 can be tightly wound around the second boss 74 when the first boss 73 is rotated by the main motor M through the gear 76. Further, the normal inner diameter of the spring 75 is set to be slightly smaller than the outer diameter of the first boss 73.

In the above-described structure, when the solenoid 6 is turned on and the locked sleeve 70 is released from the ratch 61, the spring 75 presses the first boss 73 since the inner diameter of the spring 75 is smaller than the outer diameter of the first boss 73. This pressure by the spring 75 is further tightened as the first boss 73 is rotated. Then, the second boss 74 starts to rotate in communication with the first boss 73, followed by the rotation of the cam 71.

On the other hand, when the solenoid 6 is off, since the ratch 61 locks the sleeve 70, the spring 75 does not press the first boss 73 in spite of the rotation of the first boss 73, thereby preventing the cam 71 from rotating. In this way, the spring clutch 7 having the above-described mechanism can control the switching on and off of the rotation of the cam 71.

Figure 4:
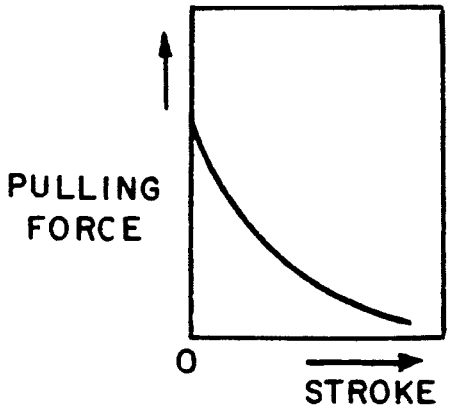
FIG. 4 is a graph showing the pulling characteristic of a solenoid.

According to the pressure control device for the transfer roller 5 described above, the solenoid 6 itself is moved by the rotation of the cam 71. This is followed by the pivotal movement of the lever 50, thus releasing the pressure of the transfer roller 5 to the photosensitive drum 1. This means the stroke of the plunger 60 is zero. Normally, a greater pulling force can be obtained with a smaller stroke, as shown in FIG. 4 which is a graph of the relationship between the pulling force and the stroke. In this way, the pulling force of the solenoid 6 can be maximized, unlike the case of the aforementioned second conventional pressure control device where the lever 50 is pivotally moved by the withdrawal of the plunger 60. This indicates that a small and inexpensive solenoid 6 is sufficient for achieving the pressure control device of this example.

Further, in the pressure control device of this example, the pressure of the transfer roller 5 can be released even when the main electric source of the image forming apparatus is turned off with the transfer roller 5 pressing the photosensitive drum 1, due to the mechanism described below.

Figure 5:
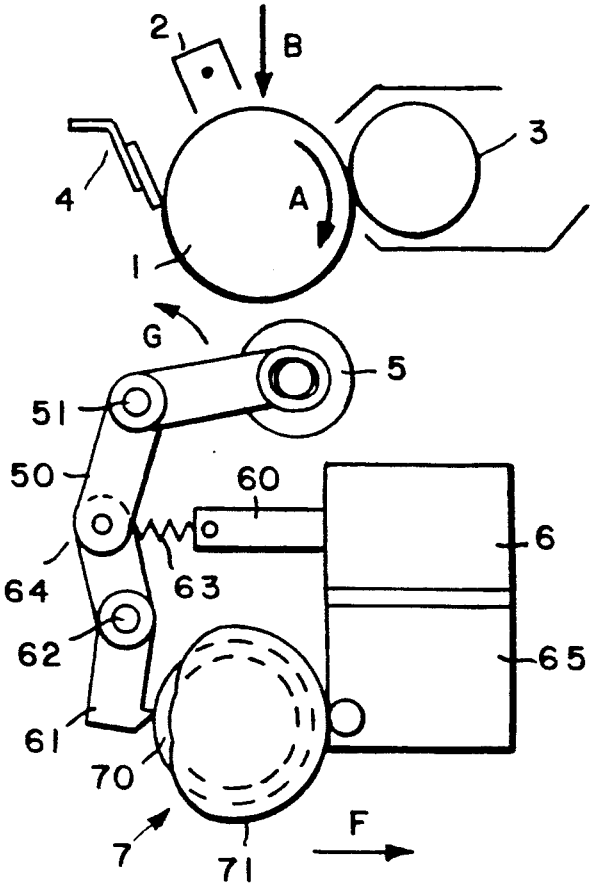
FIG. 5 is a diagrammatic view of the pressure control device of FIG. 1, showing the state thereof when the power is turned off and the pressure of the transfer roller is being released from the photosensitive drum.

Referring to FIG. 5, when the main electric source is turned off with the transfer roller 5 pressing the photosensitive drum 1, the main motor M stops rotating, and successively, the cam 71 stops rotating leaving the solenoid 6 moved in the direction of the arrow F. At this time, since the solenoid 6 is also turned off, the plunger 60 is pulled toward the spring 63 by the tensile force thereof. The force to pull the plunger 60 is increased by the weight of the transfer roller 5, finally to allow the lever 50 to pivotally move around the horizontal support 51 in the direction opposite to arrow G (clockwise), thus releasing the pressure of the transfer roller 5. In this way, both the photosensitive drum 1 and the transfer roller 5 are protected from being deformed even when the image forming apparatus is kept unused for a long period of time.

It should be understood that the pressure control device of this example is not limited to the application to the transfer roller 5 as described, but can also be applied to a pressing roller for a fixing device, or the like.

Example 2

Figure 6:
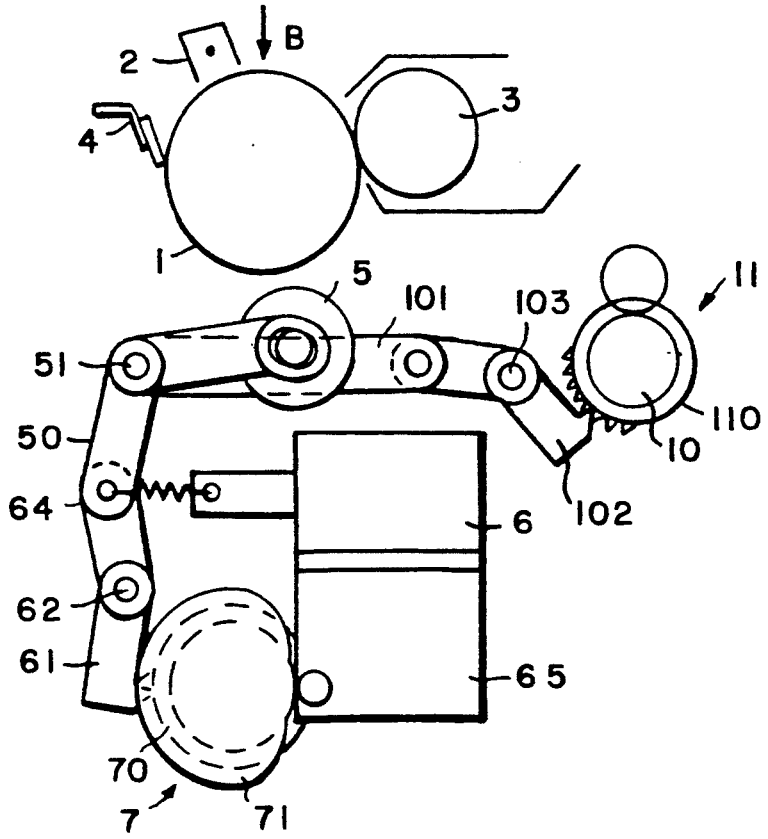
FIG. 6 is a diagrammatic view of another pressure control device of the present invention, showing the state thereof when the pressure of the transfer roller is released from the photosensitive drum.
Figure 7:
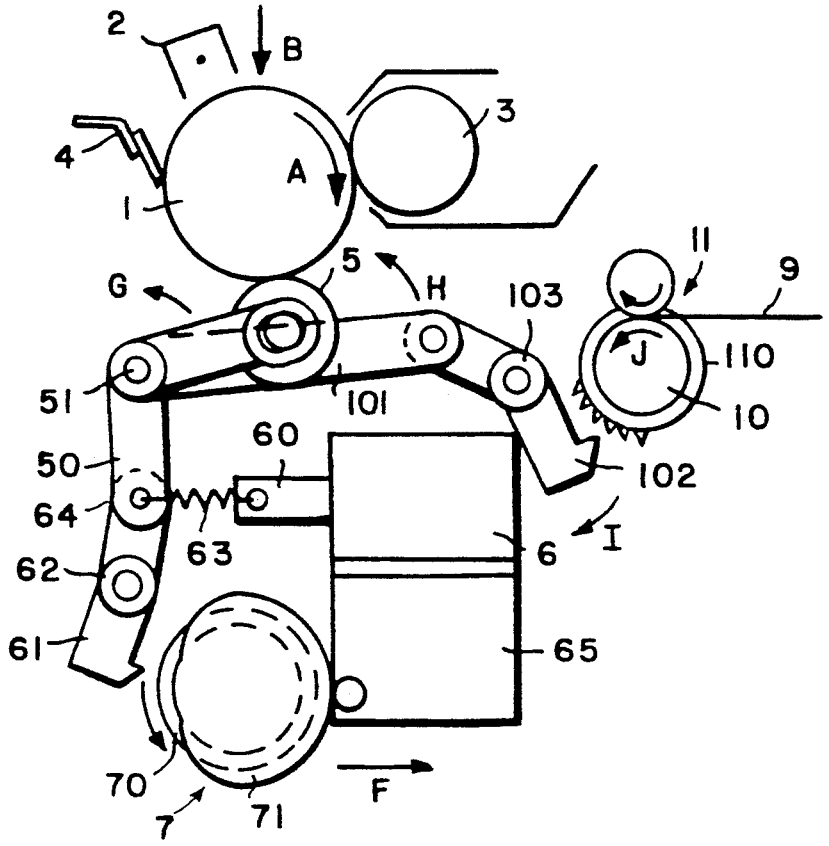
FIG. 7 is a diagrammatic view of the pressure control device of FIG. 6, showing the state thereof when the pressure of the transfer roller is applied to the photosensitive drum.
Figure 8:
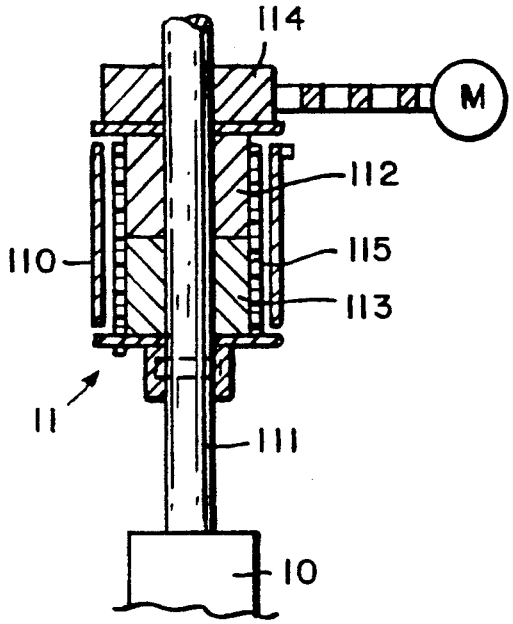
FIG. 8 is a longitudinal sectional view showing a spring clutch of the pressure control device of FIG. 6.

FIGS. 6 to 8 show a second example of the present invention, in which the solenoid 6 controls both the pressure application of the transfer roller 5 to the photosensitive drum 1 and the drive of a timing roller 10 (i.e., the transportation of the sheet 9). The pressure control of the transfer roller 5 is the same as Example 1, of which description is therefore omitted here, and new points only will be described as follows.

An arm 101 is coupled at one end to the lever 50 so as to move with the lever 50, and the other end of the arm 101 is coupled to a ratch 102 by a pin. The ratch 102 pivotally moves around a horizontal support 103. In FIG. 6, the ratch 102 is engaged to a sleeve 110 of a spring clutch 11 coupled to one axial end of the timing roller 10, thereby locking the rotation of the sleeve 110. This is the condition where the solenoid 6 is not energized and the pressure of the transfer roller 5 is released from the photosensitive drum 1.

Referring to FIG. 7, when the solenoid 6 is turned on, the ratch 61 releases the locking of the sleeve 70, the solenoid 6 moves in the direction of arrow F in accordance with the rotation of the cam 71, and consequently the lever 50 pivotally moves in the direction of arrow G so as to allow the transfer roller 5 to press the photosensitive drum 1, as described in Example 1. At this time, simultaneously with the movement of the lever 50, the arm 101 pivotally moves in the direction of arrow H, and the ratch 102 coupled to the arm 101 pivotally moves around the horizontal support 103 in the direction of arrow I (clockwise). This results in the release of the locking of the sleeve 110, and the timing roller 10 starts to rotate in the direction of arrow J due to the mechanism of the spring clutch 11 which will be described below.

FIG. 8 shows the detail of the spring clutch 11 which operates to switch on and off the rotation of the timing roller 10. An axis 111 is coupled at one end thereof to one axial end of the timing roller 10. A boss of a two-part structure composed of first and second bosses 112 and 113 is disposed around the opposite end portion of the axis 111 to the timing roller 10. A gear 114 which transmits a driving force from the main motor M to the first boss 112 is disposed on the end face of the first boss 112. The second boss 113 is fixed to the axis 111. The sleeve 110 is placed so as to face the circumferential surfaces of the first and second bosses 112 and 113, and a spring 115 is wound between the bosses 112 and 113 and the sleeve 110. One end of the spring 115 is connected to one end portion of the sleeve 110 and the other end thereof is connected to one end portion of the second boss 113. The spring 115 is wound in such a direction that the spring 115 can be tightly wound around the second boss 113 when the first boss 112 is rotated by the main motor M through the gear 114. Further, the normal inner diameter of the spring 115 is set to be slightly smaller than the outer diameter of the first boss 112.

In the above-described structure, when the solenoid 6 is turned on and the locked sleeve 110 is released from the ratch 102, the spring 115 presses the first boss 112 since the inner diameter of the spring 115 is smaller than the outer diameter of the first boss 112. This pressure by the spring 115 is further tightened as the first boss 112 is rotated. Then, the second boss 113 starts to rotate in communication with the first boss 112, followed by the rotation of the axis 111 and then the rotation of the timing roller 10.

On the other hand, when the solenoid 6 is not energized, since the ratch 102 locks the sleeve 110, the spring 115 does not press the first boss 112 in spite of the rotation of the first boss 112, thereby preventing the axis 111 and the timing roller 10 from rotating. In this way, the spring clutch 11 having the above-described mechanism can control the switching on and off of the rotation of the timing roller 10.

In the above-described structure, both the pressure application of the transfer roller 5 to the photosensitive drum 1 and the rotation of the timing roller 10 can be controlled by one solenoid 6. This reduces the number of the components of the image forming apparatus, simplifying the structure thereof and saving space around the photosensitive drum 1. This is advantageous in realizing compactness and cost reduction of the image forming apparatus.

Example 3

Figure 9:
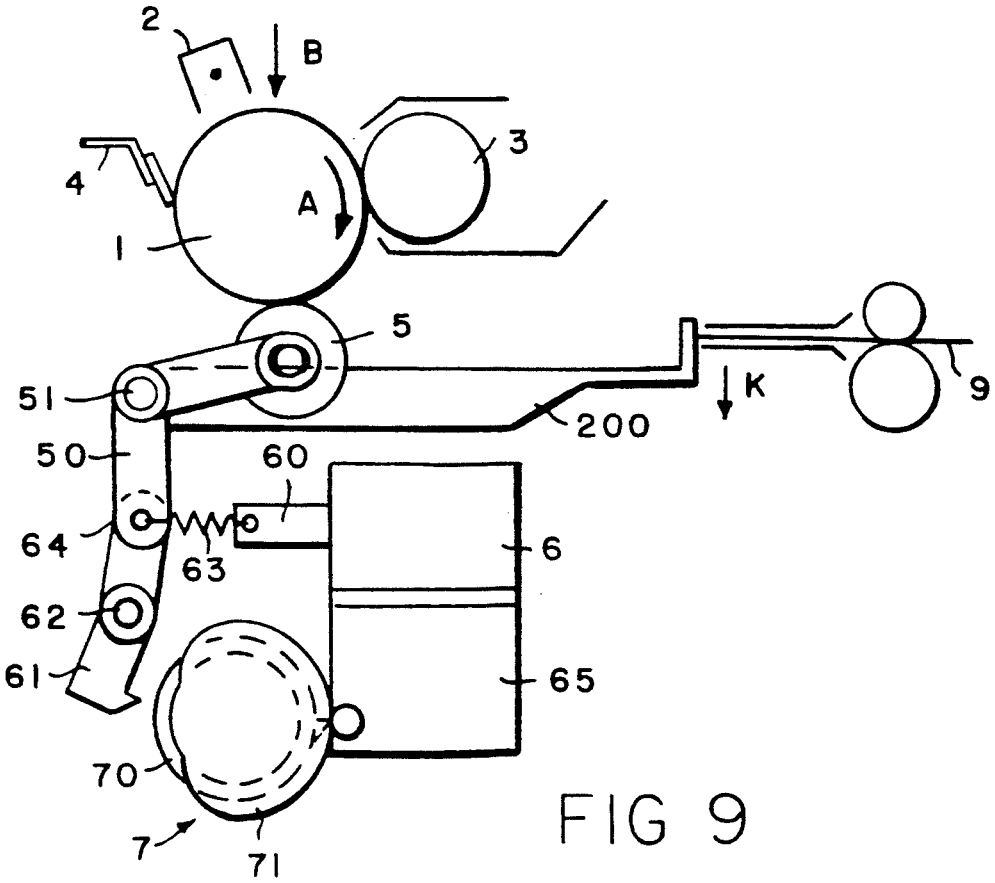
FIG. 9 is a diagrammatic view of still another pressure control device of the present invention.
Figure 10:
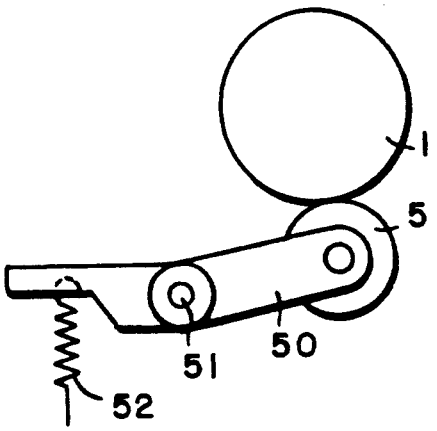
FIG. 10 PRIOR ART
FIG. 10 is a diagrammatic view of a conventional pressure control device.
Figure 11:
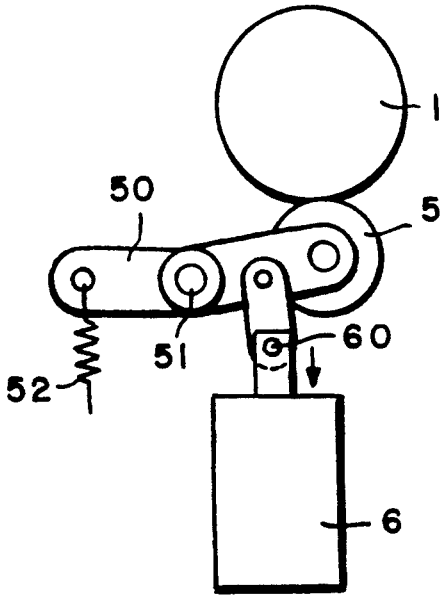
FIG. 11 PRIOR ART
FIG. 11 is a diagrammatic view of another conventional pressure control device.
Figure 12:
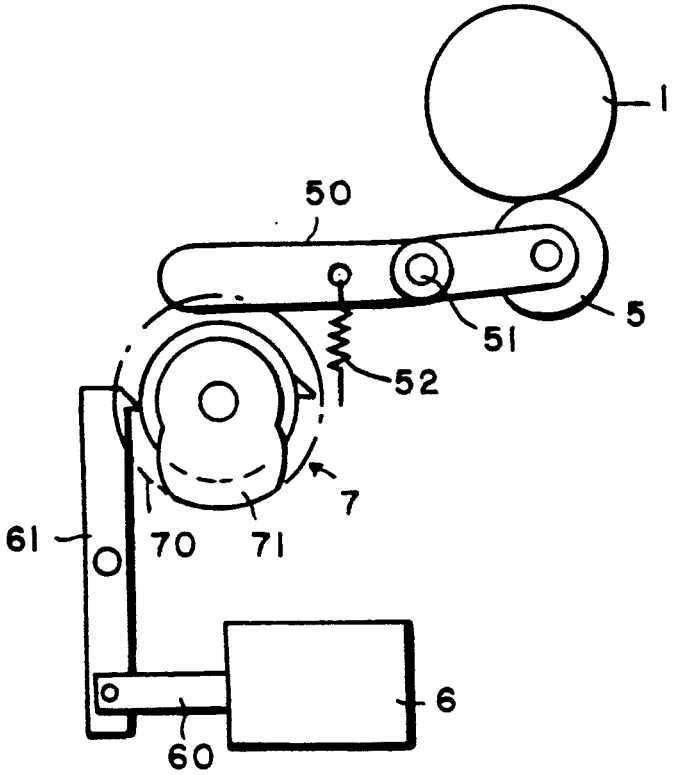
FIG 12 PRIOR ART
FIG. 12 is a diagrammatic view of yet another conventional pressure control device.

FIG. 9 shows a third example of a pressure control device for a pressure roll of the present invention, which is applied to an image forming apparatus using a timing plate 200 in place of the timing roller 10 of Example 2.

When the solenoid 6 is switched on and off, the timing plate 200 is pivotally moved in the direction of an arrow K and in the direction opposite to the arrow K, respectively, so as to control the transportation of the sheet 9. The other structure and mechanism of this example is the same as the above examples. In the image forming apparatus using the pressure control device of this example, it is possible to further reduce the number of components, simplifying the structure thereof, thus realizing cost reductions.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A pressure control device for controlling the application of pressure provided by a pressure roller to a pressing object, the pressure control device comprising:

a support member for pivotally supporting the pressure roller, the support member having a joint portion and being movable between a first position and another position;

a first locking member coupled with the joint portion of the support member;

a solenoid for moving said joint portion of said support member between said first position and said another position and also thereby moving said first locking member;

an eccentric cam switchable between a locked state and an unlocked state by the first locking member;

a clutch for rotating the eccentric cam by a driving means connected thereto, said eccentric cam being located adjacent to the solenoid and being operative to move the solenoid reciprocally;

wherein, upon energization of the solenoid, the eccentric cam is unlocked by the first locking member and rotated, thereby moving the solenoid.

2. A pressure control device for a pressure roller according to claim 1, wherein the solenoid is held by a holder, and the holder is pushed by the eccentric cam to move together with the solenoid.

3. A pressure control device for a pressure roller according to claim 1, wherein the clutch is a spring clutch.

4. A pressure control device for a pressure roller according to claim 3, wherein the first locking member includes a ratch, the ratch being engageable with a claw that is formed on a sleeve of the spring clutch.

5. A pressure control device for a pressure roller according to claim 1, further comprising a rotary locking mechanism having a second locking member and a second spring clutch, said rotary locking mechanism being coupled to the opposite end of the support member to the first locking meember, the rotary locking mechanism operating to either lock or unlock the rotation of a timing roller which transports a sheet between the pressure roller and the pressing object in a period for the rotary locking mechanism to operate to unlock the rotation of the timing roller.

6. A pressure control device for a pressure roller according to claim 1, wherein the support member is pivotably coupled with a sheet stopper member so as to control the transportation of the sheet.

7. A pressure control device for a pressure roller according to claim 1, wherein the pressure roller is a transfer roller used in an image forming apparatus.

* * * * *